US005598853A

United States Patent [19]

Hyre

[11] Patent Number: 5,598,853

[45] Date of Patent: Feb. 4, 1997

[54] IGNITION DEVICE AND APPARATUS FOR FILTERING AND PURIFYING SIDE-STREAM AND SECOND-HAND TOBACCO SMOKE

[76] Inventor: Jon Hyre, 5738 Camp Bowie Blvd., Forth Worth, Tex. 76107

[21] Appl. No.: 621,231

[22] Filed: Mar. 25, 1996

Related U.S. Application Data

[63] Continuation-in-part of Ser. No. 362,972, Dec. 23, 1994, Pat. No. 5,501,234.

[51] Int. Cl.[6] ..... A24F 47/00

[52] U.S. Cl. ..... 131/175; 131/185; 131/202

[58] Field of Search ..... 131/329, 175, 131/187, 185, 200, 202

[56] References Cited

U.S. PATENT DOCUMENTS

| | | | |
|---|---|---|---|
| 4,172,460 | 10/1979 | Robertson | 131/175 |
| 4,369,789 | 1/1983 | Jackson . | |
| 4,790,332 | 12/1988 | Wallace . | |
| 4,899,766 | 2/1990 | Ross, Jr. . | |
| 4,993,435 | 2/1991 | McCann . | |
| 5,078,155 | 1/1992 | Grandel . | |
| 5,088,508 | 2/1992 | Duncan . | |
| 5,160,518 | 11/1992 | Vega, Jr. . | |
| 5,240,014 | 8/1993 | Deevi et al. . | |
| 5,388,595 | 2/1995 | Shafer | 131/185 X |
| 5,396,907 | 3/1995 | Rojas Henao et al. | 131/175 |

FOREIGN PATENT DOCUMENTS 687571 8/1930 France .

*Primary Examiner*—Jennifer Bahr
*Attorney, Agent, or Firm*—Richard C. Litman

[57] ABSTRACT

An ignition-filtering system including a multi-stage filtering apparatus with a gravitationally activated ignition device to permit complete isolation of the lighting and smoking process. The ignition-filtering system filters second-hand smoke exhaled by a smoker, side-stream smoke which is evolved from the burning tip of a cigar or cigarette, and initial combustion smoke and gases. The ignition device is battery powered and includes an electrical ignition coil. The multi-stage filtering apparatus includes an enclosure surrounding a smoking product and a base having a filter assembly. A catalytic converter surrounds the smoking product within the enclosure The filters inside the assembly may include a condensation filter, a smoke-absorbing filter, a desiccating filter, a bacteriostatic filter, and a deodorizing filter. Two concentrically disposed smoke conduits provide passage for smoke to be inhaled by the user, and then exhaled back into the enclosure, where the smoke is dried, filtered, and catalytically decontaminated.

9 Claims, 2 Drawing Sheets

IGNITION DEVICE AND APPARATUS FOR FILTERING AND PURIFYING SIDE-STREAM AND SECOND-HAND TOBACCO SMOKE

CROSS-REFERENCE TO RELATED APPLICATION

This application is a continuation-in-part of application Ser. No. 08/362,972 filed Dec. 23, 1994, now U.S. Pat. No. 5,501,234.

BACKGROUND OF THE INVENTION

1. Field of the Invention

The present invention relates to filtering and purifying devices for tobacco smoke. More specifically, the present invention relates to an ignition device in combination with a multi-stage tobacco smoke filtering apparatus which filters both second-hand smoke exhaled by a smoker, and side-stream smoke which is evolved from the burning tip of a cigar or cigarette.

2. Description of the Prior Art

Tobacco has been a staple cash crop of the American eastern seaboard since the earliest European settlers set foot in the Americas. Beginning in the middle 1700's, large exportation of tobacco products to Europe made smoking tobacco a very popular personal habit. However, it was not until the 20th century that smoking cigarettes became popular in Western culture. Cigarette smoking in the U.S. increased steadily throughout both World War I and World War II, in spite of the increasing scientific evidence that linked cigarette smoking with two previously rare lung diseases: lung cancer and emphysema.

In the 1950's, with the increasing public perception that cigarette smoking and lung cancer were linked, filtered cigarettes were first mass-marketed in the U.S. They quickly began outselling unfiltered cigarettes. Tests had shown that some, but not all, of the integral filters placed in cigarettes lowered the amount of "tar," (heavy hydrocarbon substances), and nicotine which were inhaled by the consumer. Both "tar" and nicotine had been shown to be carcinogenic and mutagenic under certain laboratory conditions.

Then, on Jan. 11, 1964, U.S. Surgeon General Luther Terry issued the now-famous report linking smoking with lung cancer. Actually, the report was a review and summary of evidence that had been accumulated by scientists since the beginning of the 1950's. This date, however, marks the official origin of the now widely held belief that cigarette smoking is both an individual and public health hazard.

It is generally accepted that smoking is a primary causative factor of lung cancer and emphysema. Moreover, many recent studies appear to indicate that inhalation of a smoker's second-hand or side-stream smoke also raises the risk of contracting a smoking-related disease. These more recent studies have been the impetus for government restrictions on smoking based on its deleterious effect on the public health. For instance, early on, cigarette advertising was banned from television. More recently, federal and state legislation has been enacted which bans smoking from most work places, restaurants, airplanes, and other public areas. Despite the many restrictions on smoking in public, many Americans continue to smoke cigarettes regularly. This endangers the health not only of the smokers, but those around them who are subjected to the second-hand and side-stream smoke produces by the smokers. To lower the danger of smoking, as well as to protect non-smokers from tobacco smoke, numerous cigarette filtering media and devices have been patented.

Of particular note are the following patents: U.S. Pat. No. 4,369,798 to A. C. Jackson, issued Jan. 25, 1983, which describes a combination cigarette holder and cigarette smoke catcher. This device includes a cigarette-holding body having a pair of cylindrical passageways passing therethrough. One passage holds the unlit end of a cigarette, and includes a one-way valve to permit smoke to pass through the passageway when the user inhales on a mouthpiece. The second passageway terminates in a smoke catcher cartridge. This passageway also includes a one-way valve which allows smoke exhaled by the user to enter the smoke catcher cartridge. The combination of valves precludes smoke exhaled by a user (second-hand smoke) from being released into the atmosphere. This device, however, does not trap side-stream smoke, i.e., smoke which is evolved from the burning tip of the cigarette.

A very similar device is described in U.S. Pat. No. 4,790,332 to F. E. Wallace, issued Dec. 13, 1988. Here the device is essentially identical to the Jackson device, above, but also includes a filter housing which fits over the burning tip of the cigarette. Smoke is inhaled from the housing through a first passageway, and exhaled back into the housing through a second passageway back. The walls of the housing are formed from air-permeable bilayer filter media. Once the pressure inside the housing is sufficiently greater than the pressure outside the housing, smoke from within the housing will be forced through the filter media to the ambient environment.

Another related smoke catching device is described in U.S. Pat. No. 4,899,766 to J. R. Ross, Jr., issued Feb. 13, 1990. This device includes a housing designed to accommodate a pipe, cigar, or cigarette, with the lip portion of the smoking product extending outside of the housing. The housing may also include a port for mounting a lighter in the proper orientation to ignite the smoking product. After being lit, smoke is inhaled by the user, and exhaled into a second chamber which acts a smoke dump. The smoke dump may include filtering means, and/or a fan to vent smoke to an external environment.

A cigarette-smoke filtering device is described in U.S. Pat. No. 4,993,435 to S. McCann, issued Feb. 19, 1991. The McCann device is very similar to the Wallace device described above. Here, a housing defines two parallel chambers, each having an air inlet and an air outlet. The first chamber is shaped to encase the entire length of a cigarette, with the filter end of the cigarette extending outside of the chamber. The second chamber includes a plurality of filtering elements which filter cigarette smoke which is exhaled by the user into the chamber. Smoke inhaled by the user from the cigarette contained in the first chamber is exhaled into the second chamber, where the smoke is filtered prior to being vented back into the ambient environment.

U.S. Pat. No. 5,078,155 to R. L. Grandel, issued Jan. 7, 1992, describes an ashtray which includes a cylindrical housing mounted on a pair of semi-circular mounting elements. The mounting elements may be adjusted so that ashes from a cigarette placed into the ashtray fall into the cylindrical housing.

U.S. Pat. No. 5,088,508 to S. A. Duncan, issued Feb. 18, 1992, describes a "smokeless" ashtray for capturing side-stream tobacco smoke. The ashtray has a smoke capture chamber which includes an ignition source which burns the side-stream smoke which is evolved from the cigarette. This device does not include means to capture smoke exhaled by a smoker.

U.S. Pat. No. 5,160,518 to J. G. Vega, Jr., issued Nov. 3, 1992, describes a smoke filtering apparatus which also includes two parallel chambers: a first chamber to hold a cigarette or other smoking product, and a second chamber into which the user exhales tobacco smoke which is then filtered prior to being released into the ambient environment.

U.S. Pat. No. 5,240,014 to S. C. Deevi et al., issued Aug. 13, 1993, discloses a method to catalytically convert carbon monoxide into benign substances using a carbonaceous heat source which includes a catalytic precursor. When the carbonaceous heat source is ignited, the catalytic precursor within the heat source is converted into a catalyst, which then catalyzes the conversion of carbon monoxide into non-toxic substances.

French Patent No. 687,571, issued Aug. 11, 1930, describes a cigarette holding device which includes a bell-shaped housing into which a cigarette is placed. The bell housing includes perforations passing therethrough, and a mouthpiece which grasps the end of a cigarette.

None of the above references, taken alone, or in any combination, is seen as describing the present invention.

SUMMARY OF THE INVENTION

The present invention is a filtering apparatus to filter and purify side-stream and second-hand smoke from tobacco products. The present invention includes an open-ended enclosure into which is placed a tobacco product. For the sake of brevity, the smoking product shall hereinafter be referred to as a cigarette. This is for illustrative purposes only. The present invention will function equally well with cigars and other smoking products.

A cigarette is frictionally mounted within the enclosure to a first smoke conduit which is located concentrically within a second smoke conduit, both of which define passages from within the enclosure to space outside the enclosure. Adjacent to the smoke conduits is a heat-activated catalytic converter which catalyzes the transformation of carbon monoxide within tobacco smoke into non-harmful compounds. After the cigarette is ignited, the enclosure is removably engaged to a base which includes a multi-stage air-filtering passageway.

The heat of the lighted cigarette activates the catalytic activity of the heat-activated catalytic converter. Smoke is inhaled by a user via the first smoke conduit. The smoke inhaled by the user is then exhaled back into the enclosure via the second smoke conduit. A top closure may be placed over both of the smoke conduits to seal smoke within the enclosure. In this manner, both side-stream and second-hand smoke are confined to the space within the enclosure.

The smoke within the enclosure then passes through a number of filters which may include a condensation filter, a smoke-absorbing filter, a desiccating filter, a bacteriostatic filter, and a deodorizing filter. The filters may be removable singularly, or removable as a single filtering cartridge unit. A capped axial bore passing through the filters provides a means to collect and dispose of condensation isolated from the smoke within the enclosure. The smoke passing through the various filters is completely filtered, deodorized, and decontaminated so as to protect non-smokers from side-stream and second-hand smoke.

In an alternative embodiment, the filtering apparatus of the present invention is used in conjunction with a gravitationally activated ignition device for the cigarette or other tobacco products. The ignition device is mounted within the enclosure of the present filtering apparatus and includes a battery powered electrical heating element to initiate combustion of the cigarette.

In light of the above discussion, it is a principal object of the present invention to provide an apparatus for filtering and purifying side-stream and second-hand tobacco smoke.

It is another object of the present invention to provide a multi-stage filtering apparatus which physically filters, chemically treats, and catalytically transforms the harmful compounds in tobacco smoke into non-harmful compounds.

A further object of the present invention is to provide a filtering and purifying apparatus which prevents the exposure of non-smokers to side-stream and second-hand smoke from tobacco products.

It is a further object of the present invention to provide the multi-stage filtering apparatus with an ignition device to permit complete isolation of the cigarette lighting and smoking process.

These and further objects of the present invention will become clear upon a complete reading of the following detailed description and accompanying drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
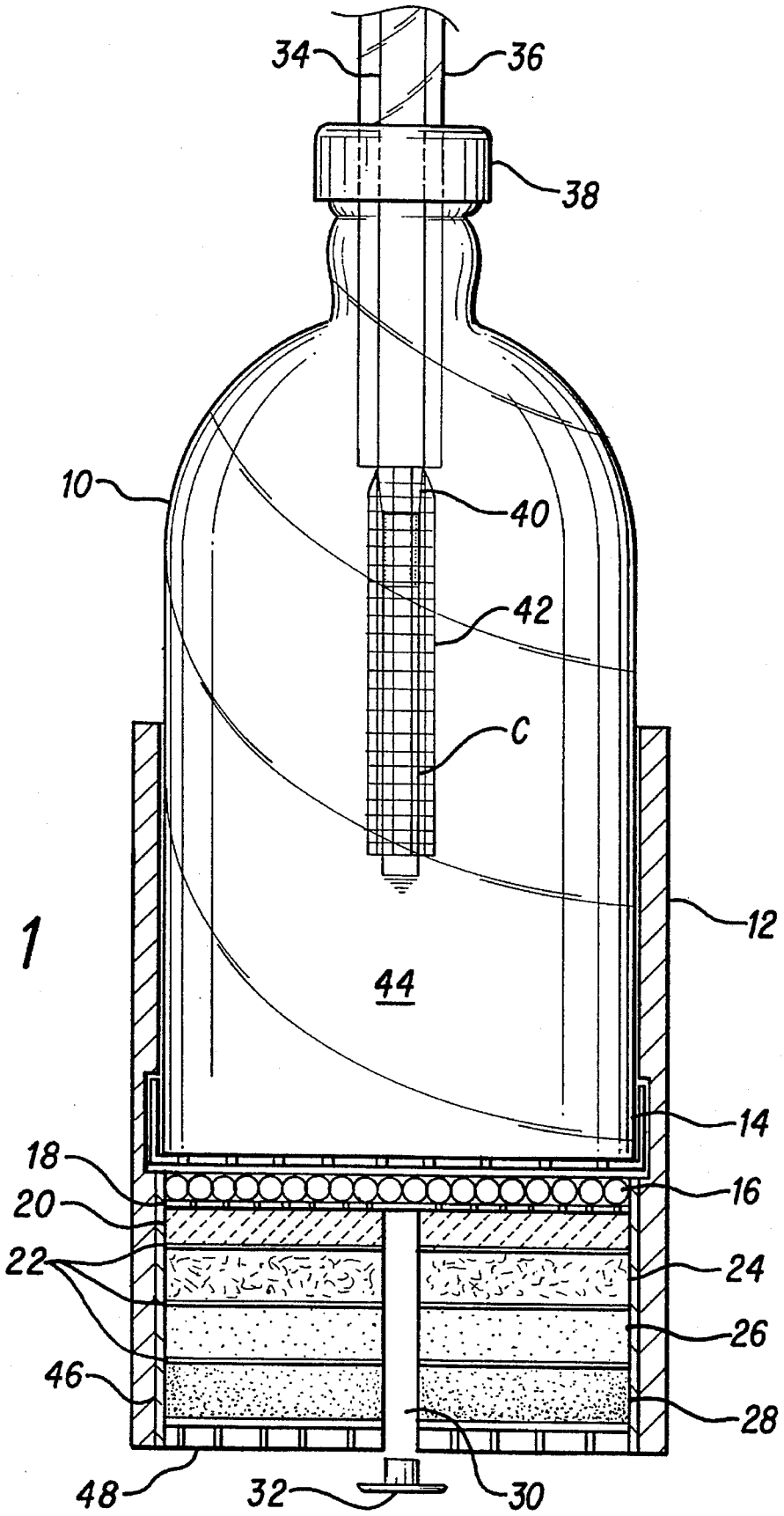
FIG. 1 is a front elevational view of a side-stream and second-hand smoke filtering apparatus according to the present invention.

Referring to FIG. 1, the filtering apparatus according to the present invention includes an open-ended enclosure 10 and a cap 38 releasably engaged to the smaller end of the enclosure 10. The cap 38 has a central aperture defining a first smoke conduit, through which a first tube 36 passes. A second tube 34 is located concentrically within the first tube 36, and defines a second smoke conduit.

A cigarette support 40 is connected to one end of the second tube 34. The support 40 is dimensioned and configured to frictionally engage a cigarette C, cigar, pipe, and the like. Connected to the support 40 is a heat-activated catalytic converter 42. The catalytic converter is preferably made from a wire coated with platinum and rhodium. The catalytic converter may also contain other known heterogeneously catalytic metals including Raney nickel, silver, palladium, and the like.

The larger open end of the enclosure 10 is frictionally and releasably engaged to a base 12. When mated to the base, the enclosure 10 and base 12 define an inner volume 44, in which smoke from the cigarette C is trapped.

A plurality of filtering elements are positioned axially within the base and define an air-permeable filtering passageway from the inner volume 44 to the outside environment. The filtering elements include a condensation filter 16, a smoke-absorbing filter 20, a desiccating filter 24, a bacteriostatic filter 26, and a deodorizing filter 28. Each of the filtering elements may include a central opening therethrough. When placed into the base, the central openings of the filters, in registration, define an open central bore 30 which passes through the center of the filtering elements. A releasable closure 32 is provided to seal the bore 30.

Each of the filter elements of any desired thickness may be individually removed, or the entire filter assembly may be removed as a self-contained filter cartridge. In the latter case, the filter elements would be confined within removable housing 46 having perforated bottom 48. In this embodiment, once the filter elements are exhausted, the enclosure 10 is removed from the base 12, and the removable housing 46 removed from the base. A new filter cartridge would then be placed into the base. The filter cartridge is preferably retained within the base via a friction fitting. Other releasably fastening means, however, such as threaded fasteners, function with equal success.

When placed into the base, enclosure 10 rests upon a perforated tray 14. The tray 14 not only provides a tight fit between the enclosure and the base, it also serves to collect ashes from the burning cigarette, and to isolate the filter elements from disruption.

Directly below the perforated tray 14 is the first filter element, a condensation filter 16. Preferably, the condensation filter is a layer of spherical glass beads, or glass rods. This filter serves to condense moisture from the cigarette smoke and air introduced into filter from the user's exhaled breath. Because of their relatively large size, a rigid perforated disk 18 may separate this filter element from the remaining filters.

A smoke absorbing filter 20 is preferably located directly below the condensation filter 16. Preferably, the smoke-absorbing filter can be made of a layer of silica gel, although other smoke absorbing media may be used. Such media include, but are not limited to alumina gels, diatomaceous earth, zeolytic or hepafilter materials and the like.

Filter dividers 22 may separate the individual filter elements. These filter dividers may be any type of air-permeable membrane. Preferably, the dividers 22 are porous paper sheets which are either treated or untreated. Such treatments may include treating with finishing agents, stiffeners, desiccants, colorants, and the like.

A desiccating filter 24 functions to absorb, entrap, or in any manner immobilize the moisture condensed by condensing filter 16. The desiccating filter is preferably made of a layer of solid hygroscopic material. Any type of hygroscopic material will function in the present invention, so long as the hygroscopicity of the material is sufficiently high to immobilize the moisture which enters the filter.

A bacteriostatic filter 26 functions to prevent the growth of bacteria within the filter media. Because moisture will be trapped within the filter, there is a possibility that, absent a bacteriostatic agent, the filter media itself might provide a suitable grounds for the growth of bacterial colonies. Preferably, the bacteriostatic filter is a bacteriostatically-treated cellulose fiber.

A deodorizing filter 28 functions to deodorized the filtered air as it passes into the ambient environment. Preferably the deodorizing filter is a layer of activated carbon. This filter may include perfumes and the like as well.

In operation, a cigarette C, or other smoking material, is placed in support 40, in close proximity to catalytic converter 42. The enclosure 10 is then placed within the base 12. The user then draws smoke from the cigarette by creating an oral vacuum on tube 34. The user then exhales the tobacco smoke back into the enclosure 10 via tube 36. A top (not shown) may be releasably fastened about both of tubes 34 and 36 to seal all smoke inside the enclosure. The smoke within volume 44 then must pass through all of the filters described above prior to being released into the ambient environment. The closure 32 may be periodically removed to drain any excess moisture which accumulates within the filters.

Figure 2:
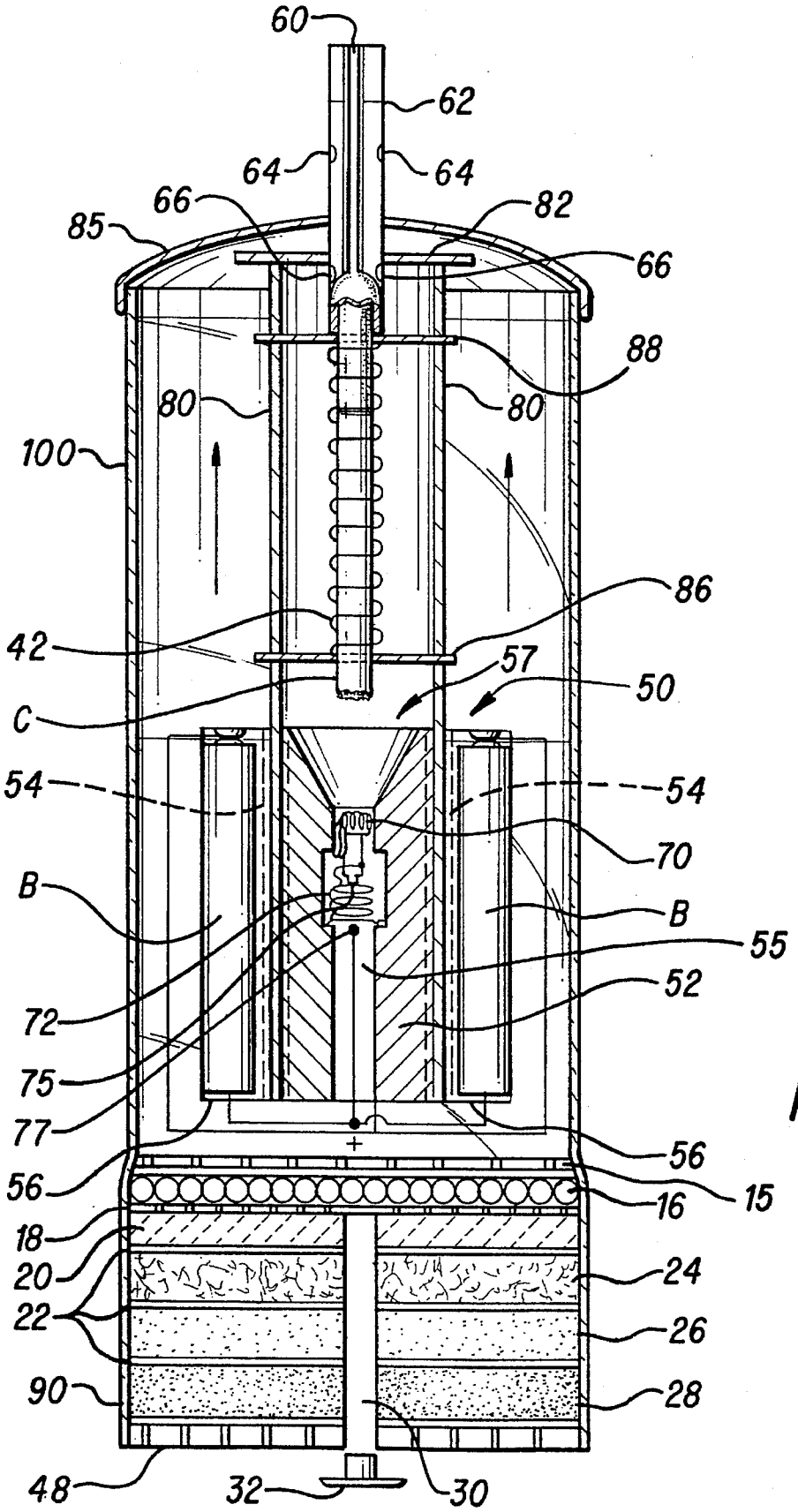
FIG. 2 is a front elevational view of an ignition-filtering system according to an alternate embodiment of the present invention.

An alternate preferred embodiment of the present invention is shown in FIG. 2. This embodiment is basically the same as that shown in FIG. 1, but includes a gravitationally activated ignition assembly 50 to initiate lighting the cigarette without the use of an open flame. Also, this embodiment includes an inner smoke tube 60 and a concentric outer smoke tube 62 which are hermetically sealed at both their ends.

The ignition assembly 50 includes a cylindrical housing 52 having a central aperture 55 in communication with an open funnel 57. Opposing bores 54 and battery compartments 56 vertically extend through housing 52, which may be made of any suitable fireproof material. Central aperture 55 contains ignition coil 70 which is electrically connectable to spring switch 72 having spaced apart contact points 75 and 77. A protective screen may be placed above ignition coil 70, which is powered by batteries B.

The ignition assembly 50 vertically slides along parallel rails 80 which extend through housing bores 54 and terminate at support ring 82. Support ring 82 is secured to removable lid 85, which sealingly engages the top open end of cylindrical enclosure 100. Lid 85 has a central aperture through which hermetically sealed tubes 60 and 62 passes. Outer smoke tube 62 has a plurality of circumferential orifices 64 above lid 85 and a plurality of ports 66 communicating with the interior volume of enclosure 100.

Preferably, enclosure 100 is of a unitary construction and includes a base section 90 which contains the plurality of filtering elements describes hereinabove. Base section 90 has a perforated top 15 and perforated bottom 48 to allow smoke collected within the upper section of enclosure 100 to pass through the filters prior to being released to the environment.

The filter elements may be removed as a self-contained filter cartridge as described above or permanently secured within base section 90. In the latter case, once the filter elements are exhausted after continued use, the ignition assembly 50 is removed and the entire enclosure 100 may be discarded. The ignition assembly 50 including lid 85 may be retained and the disposable enclosure 100 including the filter elements may be replaced.

As shown in FIG. 2, heat-activated catalytic converter 42 is preferably a spring or spiral wire coated with a noble metal such as plantinum. Spiral catalytic converter 42 is frictionally attached at a top end to smoke tube 62 by means of support member 88. The bottom of catalytic converter 42 is secured to movable platform 86, which slides up and down rails 80. This arrangement provides for more effective catalytic activity throughout the full length of burning cigarette C, and allows for re-lighting the smoking product in the event it becomes extinguished.

In operation, when the ignition-filtering system of FIG. 2 is tilted as in a normal movement used in drinking a beverage, the ignition assembly 50 is caused to slide by gravity along rails 80 and the spiral converter 42 is pushed upward to allow the tip of cigarette C to be brought into contact with ignition coil 70. Preferably, the ignition-filtering system is raised into a steep upward angle of about 45 degrees. Upon contact with cigarette C, ignition coil 70 is forced against intermittent spring switch 72 which in turn forces the switch contact points 75 and 77 to close. Thus, the electrical circuit from batteries B is completed and ignition coil 70 is caused to heat. When ignition is achieved, ignition assembly 50 slides down guide rails 80 to reopen switch 72, thereby turning off ignition coil 70 and relieving batteries B from further drain.

In the preferred embodiment shown in FIG. 2, smoke is drawn into the mouth of the smoker through inner smoke tube 60. The smoker then exhales secondhand smoke into orifices 64 by extending the lips down the length of outer tube 62 towards the exterior surface of lid 85. The smoke is then forced into the interior chamber of enclosure 10 through entry ports 66 located directly below the interior surface of lid 85. Subsequently, smoke is forced downwardly through the filter elements 16, 20, 24, 26 and 28, prior to being released into the environment as described hereinabove with respect to FIG. 1.

The FIG. 2 embodiment of the present invention provides complete isolation of the cigarette ignition and smoking process. This preferred embodiment effectively eliminates all legitimate concerns regarding the environmental and interpersonal impact of smoking since it permits total filtration of all second-hand, side stream and initial combustion smoke and gasses. Also, the ignition-filtering system of FIG. 2 permits the ignition of tobacco products in an explosive or highly combustible environment since the electrical lighting element and lighted cigarette are contained within the sealed enclosure. In addition, the entire ignition assembly 50 may be removed from enclosure 10 for convenient cleaning.

It is to be understood that the invention is not limited in any manner to the embodiment described above, but includes any and all embodiments encompassed by the following claims.

I claim:

1. An ignition-filtering system for lighting a tobacco product and filtering side-stream, second-hand and initial combustion smoke and gasses, said system comprising:

a unitary enclosure including an open end and a base section, said base section having a perforated top and perforated bottom surface;

a plurality of filtering elements positioned within said base section and defining an air-permeable filtering passageway, each of said plurality of filtering elements having a central opening therethrough, said central openings, in registration, defining an open central bore through said plurality of filtering elements;

a closure releasably engageable within said open central bore;

a lid having a central aperture therethrough, said lid releasably engageable with said open end of said enclosure;

an inner tube and a concentric outer tube hermetically sealed at both their ends, said inner tube and said outer tube being located within said central aperture of said lid and having a first hermetically sealed end extending within said enclosure, and a second hermetically sealed end extending outside said enclosure;

said outer tube having a plurality of orifices outside said enclosure and a plurality of ports located within said enclosure;

a support connected to said first hermetically sealed end, said support dimensioned and configured to frictionally and releasable engage a smoking product;

a heat-activated catalytic converter adapted and positioned for surrounding the smoking product;

vertical rails extending between said lid and said base section; and a battery-powered ignition assembly within said enclosure, said ignition assembly being slidable along said vertical rails and including a cylindrical housing having a central aperture.

2. The ignition-filtering system according to claim 1, wherein said central aperture contains an ignition coil electrically connectable to a spring switch having spaced apart electrical contact points.

3. The ignition-filtering system according to claim 1, wherein said housing includes opposing bores and battery compartments vertically extending through said housing.

4. The ignition-filtering system according to claim 3, wherein said vertical rails extend through said bores, said rails being secured at one end to an interior surface of said lid.

5. The ignition-filtering system according to claim 1, wherein said heat-activated catalytic converter is a wire coil containing platinum and rhodium.

6. The ignition-filtering system according to claim 1, wherein said plurality of filtering elements include a condensation filter, a smoke-absorbing filter, a desiccating filter, a bacteriostatic filter, and a deodorizing filter.

7. The ignition-filtering system according to claim 6, wherein said filtering elements are sequentially arranged within said base section in the following order: said condensation filter, said smoke-absorbing filter, said desiccating filter, said bacteriostatic filter, and said deodorizing filter.

8. The ignition-filtering system according to claim 7, wherein said condensation filter is a layer of glass beads, said smoke-absorbing filter is a layer of silica, said desiccating filter is a layer of solid hygroscopic material, said bacteriostatic filter is a layer of bacteriostatically-treated cellulose fiber, and said deodorizing filter is a layer of activated carbon.

9. The ignition-filtering system according to claim 8, wherein said smoke-absorbing filter, said bacteriostatic filter, and said deodorizing filter are separated from one another by porous paper sheets.

* * * * *